US005388631A

United States Patent [19]

Suganuma et al.

[11] Patent Number: 5,388,631

[45] Date of Patent: Feb. 14, 1995

[54] DIE-CASTING APPARATUS WITH SPRAYING DEVICE FOR SOLID LUBRICANT AND DEVICE FOR CLEANING NOZZLES

[75] Inventors: Tetsuro Suganuma, Nagoya; Fumitaka Takehisa, Anjyo; Hiromi Takagi, Nagoya; Mitsuyoshi Yokoi, Takahama, all of Japan

[73] Assignee: Nippondenso Co., Ltd., Kariya, Japan

[21] Appl. No.: 52,988

[22] Filed: Apr. 27, 1993

[30] Foreign Application Priority Data

Apr. 29, 1992 [JP] Japan ..... 4-136275

[51] Int. Cl.[6] ..... B22C 3/00

[52] U.S. Cl. ..... 164/72; 164/113; 164/158; 164/267; 164/312

[58] Field of Search ..... 164/72, 267, 113, 312, 164/158

[56] References Cited

U.S. PATENT DOCUMENTS

| | | | |
|---|---|---|---|
| 3,544,355 | 12/1970 | Ott | 164/312 |
| 4,420,028 | 12/1983 | Nelson | 164/158 |
| 4,562,875 | 1/1986 | Ogoshi et al. | 164/312 |
| 4,949,775 | 8/1990 | Takehisa et al. | 164/312 |
| 4,955,424 | 9/1990 | Takehisa et al. | 164/72 |

FOREIGN PATENT DOCUMENTS

| | | |
|---|---|---|
| 983094 | 2/1965 | European Pat. Off. . |
| 1057550 | 2/1967 | European Pat. Off. . |
| 1490759 | 11/1977 | European Pat. Off. . |
| 1497936 | 1/1978 | European Pat. Off. . |
| 281318 | 9/1988 | European Pat. Off. . |
| WO9106385 | 5/1991 | European Pat. Off. . |
| 62-275558 | 11/1987 | Japan . |
| 1118353 | 5/1989 | Japan . |

*Primary Examiner*—Kuang Y. Lin

*Attorney, Agent, or Firm*—Cushman, Darby & Cushman

[57] ABSTRACT

An apparatus and method for spraying solid lubricant to obtain coatings thereof on inner surfaces of an injection sleeve and a spool bushing of a die-casting machine. The die-casting machine further includes a first spraying assembly 1 having nozzles 11 and 12 directed to the injection sleeve 85 and a second spraying assembly 2 having a nozzle 21 directed to the spool bushing 86. The nozzles 11, 12 and 21 are connected to a tank 4 for the solid lubricant. The first and second spray assemblies 1 and 2 are provided with corresponding moving devices 3 and 23 for obtaining a desired movement of the nozzles 11 and 12 and 21, respectively. Nozzle cleaning devices 71 and 72 are provided for cleaning the nozzles 11 and 12 and 21, respectively after the completion of the spraying operation.

13 Claims, 10 Drawing Sheets

X MENS THAT DIE-CASTING OPERATION IS IMPOSSIBLE ANY MORE

DIE-CASTING APPARATUS WITH SPRAYING DEVICE FOR SOLID LUBRICANT AND DEVICE FOR CLEANING NOZZLES

BACKGROUND OF THE INVENTION

1. Field of the Invention

The present invention relates to a device and a method for spraying a solid lubricant toward an injection sleeve and a spool bushing in a die-casting machine.

2. Description of Related Art

Known in the prior art is a die-casting machine, which has a fixed mold and a platen, which are provided with a spool bushing and an injection sleeve, respectively. The spool bushing and the injection sleeve form aligned cylindrical bores opening into a cavity for molding a product. A plunger is slidably inserted into the cylinder bores for injecting the molten metal into the cavity. In order to reduce the frictional force between the plunger and the injection sleeve and the spool bushing a device is provided for supplying a lubricant onto the cylindrical surfaces of the injection sleeve and the spool bushing. The coating of the lubricant serves, also, as a heat insulating layer for maintaining a desired high temperature of the molten metal material.

A liquid lubricant, such as an oil or an aqueous wax, has, heretofore, usually been used. There is, however, a recent need to obtain a die casting product of a precision as high as possible. In order to do this, an ultra-low-speed injection method is proposed, which is effective to prevent gas from being entrained when the molten metal material is injected into the cavity. In this ultra-low-speed injection method, the speed of the movement of the plunger is as low as between 3 and 5 cm/second, so that a laminar flow of the molten metal material is obtained which prevents gas from being entrained. However, the ultra-low-speed injection method causes the molten metal material to be gradually supplied, from the injection sleeve and the spool bushing, to the cavity. As a result, contact between molten metal material, at a high temperature, with the injection sleeve and the spool bushing is prolonged, which causes the lubricant to fail to thermally insulate the molten metal since the liquid lubricant is relatively easily vaporized. As a result, a need has arisen to employ a solid lubricant formed as fine solid particles dispersed in a liquid, instead of liquid lubricant, in order to improve the thermal insulation of the molten metal.

However, the conventional device for supplying the lubricant suffers from following drawbacks if it is combined with the ultra-low-speed injection method while using the solid lubricant. Namely, in the prior art system, the supply pipe is merely employed for supplying the lubricant to the injection sleeve at a location adjacent its inlet. A supply of a solid lubricant by means of this type of apparatus may cause the supplied solid lubricant to be locally concentrated in the injection sleeve and the spool bushing. Namely, unlike the liquid lubricant, the solid lubricant is not evenly spread in the injection sleeve and the spool bushing, it is difficult to obtain a uniform heat insulating coating of the lubricant. Due to the lack of a uniform coating of the lubricant, a reduction in the temperature of the molten metal occurs during the injection of the molten metal, which causes the molten metal to fail to flow smoothly into the cavity, so that a desired shape of the product after removal of the mold cannot be obtained at locations where the product is thin or at the downstream end of the flow of the molten metal in the cavity. Furthermore, at locations where the lubricant coating is thin or absent, the molten material in the injection sleeve and the spool bushing are subjected to rapid cooling. Such rapidly cooled parts in a die-cast product reduces the strength of the product.

Furthermore, the prior art construction employing a supply tube for supplying the lubricant cannot supply a thin uniform coating of the solid lubricant. As a result, portions with excessive amount of the lubricant are created in the coating, which causes the lubricant to be entrained in the molten metal, which results in voids in the molded product.

Finally, the solid lubricant is dispersed in a liquid. As a result, the small lubricant particles are apt to accumulate at the outlet end of the lubricant supply pipe. As a result, longer the lubricant supply pipe is used, smaller the effective inner diameter of the lubricant supply pipe. As a result, a reduction in the amount of the solid lubricant supplied occurs, which causes the above mentioned drawbacks to occur earlier. Furthermore, a reduction in the supply of the lubricant can cause the molten metal to adhere to the injection sleeve and/or the spool bushing, which prevents the injection plunger from being smoothly moved.

SUMMARY OF THE INVENTION

An object of the present invention is to provide an apparatus capable of always obtaining the desired coating of a lubricant on the inner surfaces of the injection sleeve and the spool bushing of a mold.

According to the present invention, a die-casting apparatus is provided, comprising:

- a fixed mold assembly;
- a movable mold assembly movable between an opened position spaced from the fixed mold assembly and a closed position where the movable mold contacts with the fixed mold to form a cavity for casting a product;
- a spool bushing opened into the cavity for introducing a molten metal material into the cavity;
- an injection sleeve connected to the spool bushing and having an inlet for the introduction of the molten metal material;
- a plunger slidably inserted to the injection sleeve for injecting the molten material from the injection sleeve to the cavity via the spool bushing;
- spraying means for obtaining flows of solid lubricant for creating a coating of the lubricant on inner surfaces of the spool bushing and the injection sleeve;
- means for moving the spraying means between an extended position for spraying the lubricant when the mold is opened and a retracted position which allows the mold to be closed, and;
- means for cleaning the spraying means after the completion of the spraying operation.

According to another aspect of the present invention, a method is provided for preparing a die-casting apparatus for a die-casting operation, the die-casting apparatus comprising a fixed mold and a movable mold which is moved between an opened position where the movable mold is placed away from the fixed mold and a closed position where the movable mold contacts with the fixed mold to form a cavity for die-casting a product, a spool bushing having an outlet for introduction a molten material to the cavity, an injection sleeve having an inlet for receiving the molten material, and a plunger slidable in the injection sleeve for injecting the molten material into the cavity via the spool bushing, the method comprising the step of:

providing spraying assemblies for generating, respectively, flows of solid lubricant;

providing nozzle cleaning devices for cleaning the spray assemblies, respectively;

moving the movable mold to the opened position after completion of a die-casting operation, while locating the spraying nozzles to face the injection sleeve and the spool bushing, respectively;

spraying the lubricant from the spraying assemblies toward the inner spaces of the injection sleeve and the spool bushing, respectively for obtaining heat insulating coatings of lubricant on the inner surfaces of the injection sleeve and spool bushing, and;

locating the spraying assemblies to cooperate with the respective nozzle cleaning assemblies for cleaning inwardly and outwardly the spraying assembly.

BRIEF DESCRIPTION OF ATTACHED DRAWINGS

DESCRIPTION OF PREFERRED EMBODIMENTS

Figure 1:
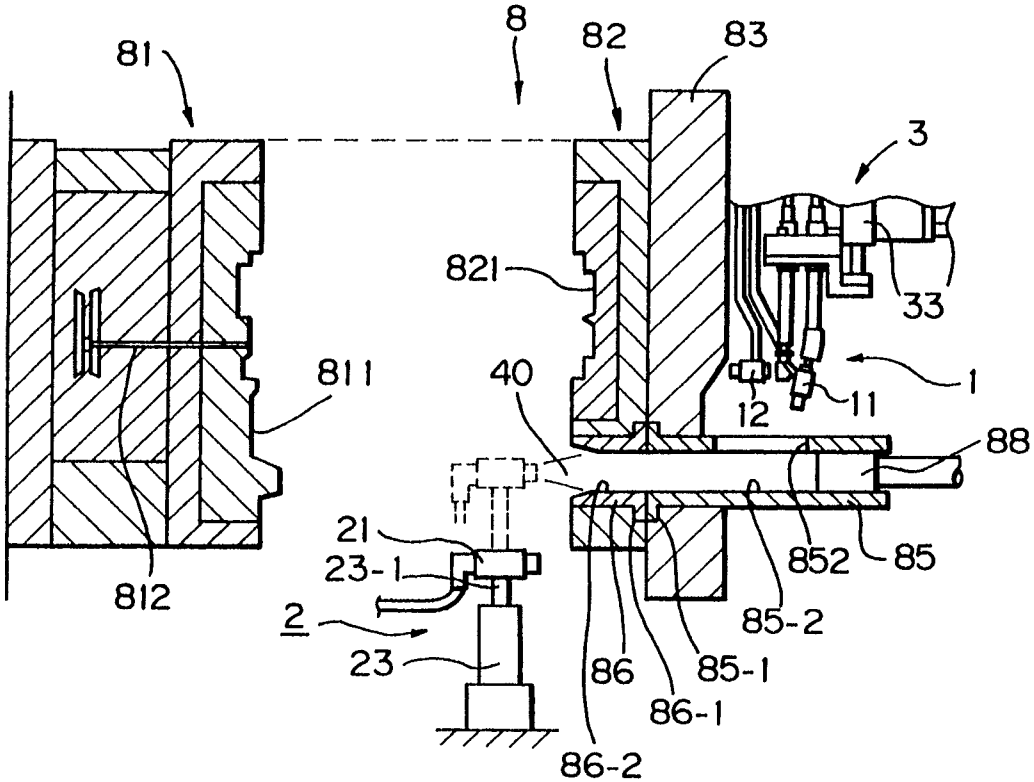
FIG. 1 is a schematic side view of a mold with lubricant spraying assemblies according to the present invention.

Now, embodiments of the present invention will be explained. FIGS. 1 to 6 show a construction of a die-casting machine with a device for spraying solid lubricant and a device for cleaning nozzles according to an embodiment of the present invention. In FIG. 1, a reference numeral 8 denotes a die-casting apparatus which includes a moving mold 81 having a recess 811 on one side, and a fixed mold 82 having a recess 821 on one side thereof facing the recess 811. The moving mold 81 is connected to a device (not shown) for moving the mold 81 toward the fixed mold 82, so that the recess 811 and 821 form a cavity into which a molten metal material is introduced for executing a die-casting operation. The moving mold 81 is provided with an ejector pin 812 which serves to detach a product as obtained from the mold when the moving mold 81 is moved away from the fixed mold. The fixed mold 82 is, at the side remote from the recess 821, connected to a platen 83. The fixed mold 82 and the platen 83 are under a face to face contact condition. An injection sleeve 85 is connected to the platen 83, while a spool bushing 86 is connected to the fixed mold 82. The injection sleeve 9 has a flange 85-1 which is flush with the surface of the platen 83 facing the fixed mold 82, while the spool bushing 86 has a flange 86-1 flush with the surface of the bushing 86 facing the platen 83. These flanges 85-1 and 86-1 are aligned and contacted with each other so that cylindrical bores inside the sleeve 85 and the bushing 86 are connected with each other for introduction of a molten material to the cavity. The injection sleeve 85 has, as its cylindrical wall, an inlet opening 852 for introducing of a molten metal material into the space inside the sleeve 85. An injection plunger 88 for injecting a molten metal material is arranged to be slidable in the aligned cylindrical bores of the fixed mold 82 and the platen 83 along an axis of the plunger 88. Namely, upon a die-casting operation, the molten metal material of high temperature is charged into the injection sleeve 85 via the inlet 852 and the spool bushing 86, and the injection plunger 88 is moved, so that the molten metal material is moved in the forward direction toward a cavity.

It should be noted, as well as in a horizontally opened mold as above explained, the present invention can be applied to a mold which is vertically opened.

Figure 2:
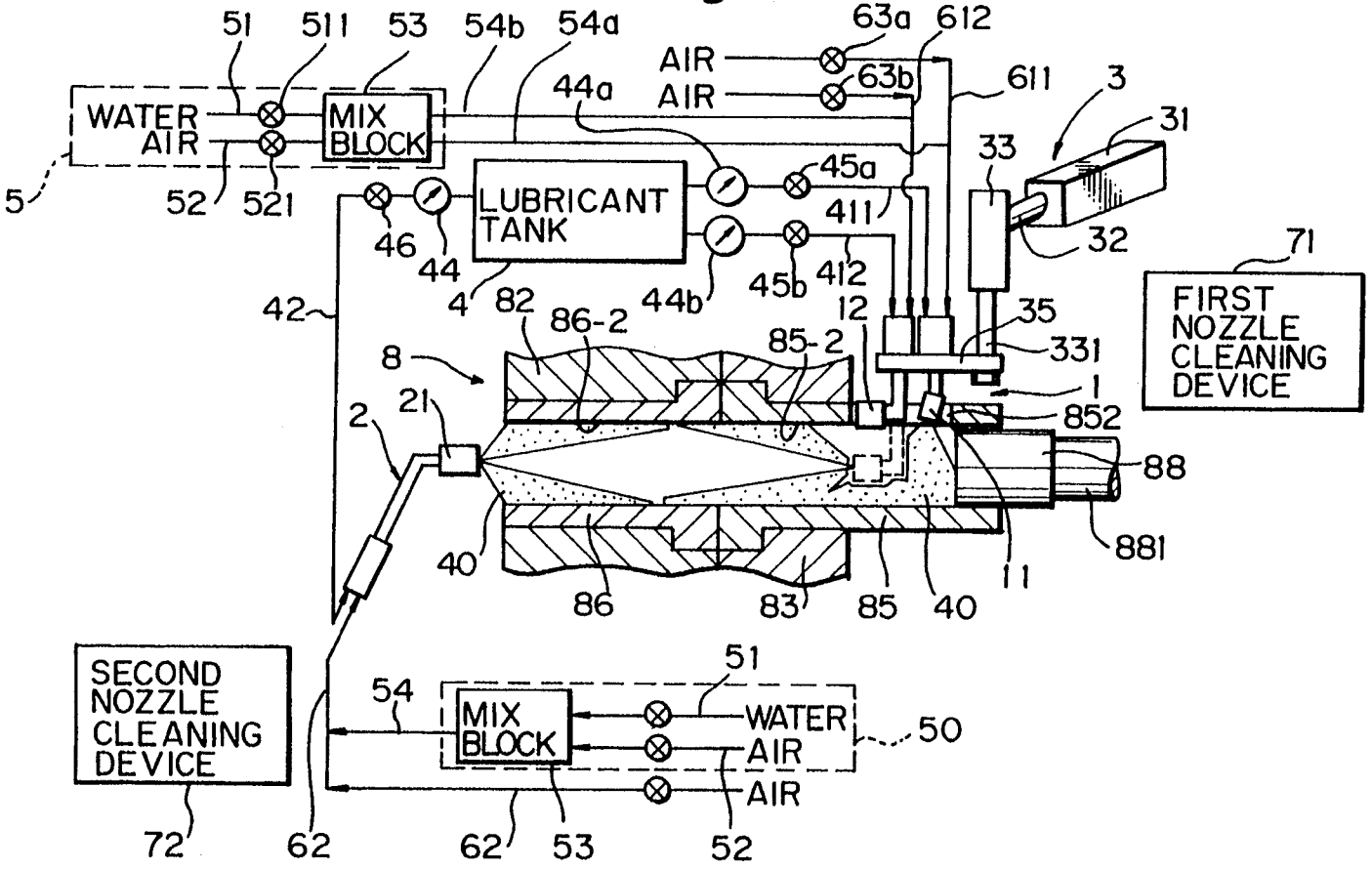
FIG. 2 shows an enlarged view of an injection sleeve and a spool bushing in FIG. 1, with a system for supplying solid lubricant and a system for cleaning spraying nozzles.

A first spraying assembly 1 is for spraying the solid lubricant toward the inner cylindrical surface 85-2 (FIG. 2) of the injection sleeve 85. The first spraying assembly 1 is connected to a device 3 for obtaining a vertical and horizontal movement of the first assembly 1 so that its nozzles 11 and 12 are introduced into the space inside the injection sleeve 85 via the inlet opening 852 when the spraying operation is carried out. A second spray assembly 2 is for spraying the solid lubricant toward the inner cylindrical surface 86-2 of the spool bushing 86. The second spray assembly 2 is connected to a device 23 for obtaining a vertical movement of the second spraying assembly 2 when the spraying operation is executed. As shown in FIG. 2, a tank 4 for the solid lubricant is connected to the first and second spraying nozzles 1 and 2, respectively. Connected to the first spraying assembly 1 is a first unit 5 for cleaning an inner side of the nozzles 11 and 12 of the first spraying assembly 1. The cleaning unit 5 includes a supply line 51 for a cleaning liquid such as water with a cleaning agent and a supply line 52 for air, a mix block 53 connected to the lines 51 and 52, and valves 511 and 521 on the lines 51 and 52, respectively. At the mixing block 53, the water and air are mixed. A second cleaning unit 50 of the same construction is provided, which is connected to the second spray assembly 2 for cleaning an inner side of a nozzle 21 the second spray assembly 2. Furthermore, nozzle cleaning units 71 and 72 are provided for cleaning outer sides of the nozzles 11 and 12, and 21 of the first and second spray assemblies 1 and 2, respectively upon completion of the lubricant spraying operation.

As shown in FIG. 2, the first spray assembly 1 is constructed by a stay 35 formed as a plate, a melt inlet nozzle 11 for obtaining a sprayed flow of the solid lubricant directed mainly to the space inside the sleeve 85 adjacent the inlet opening 852, and an inwardly directed nozzle 12 for obtaining a sprayed flow of the solid lubricant directed mainly to the space inside the sleeve 85 remote from the melt inlet port 852 and adjacent the spool bushing 86. These nozzles 11 and 12 are fixedly connected to the stay member 35.

Figure 3:
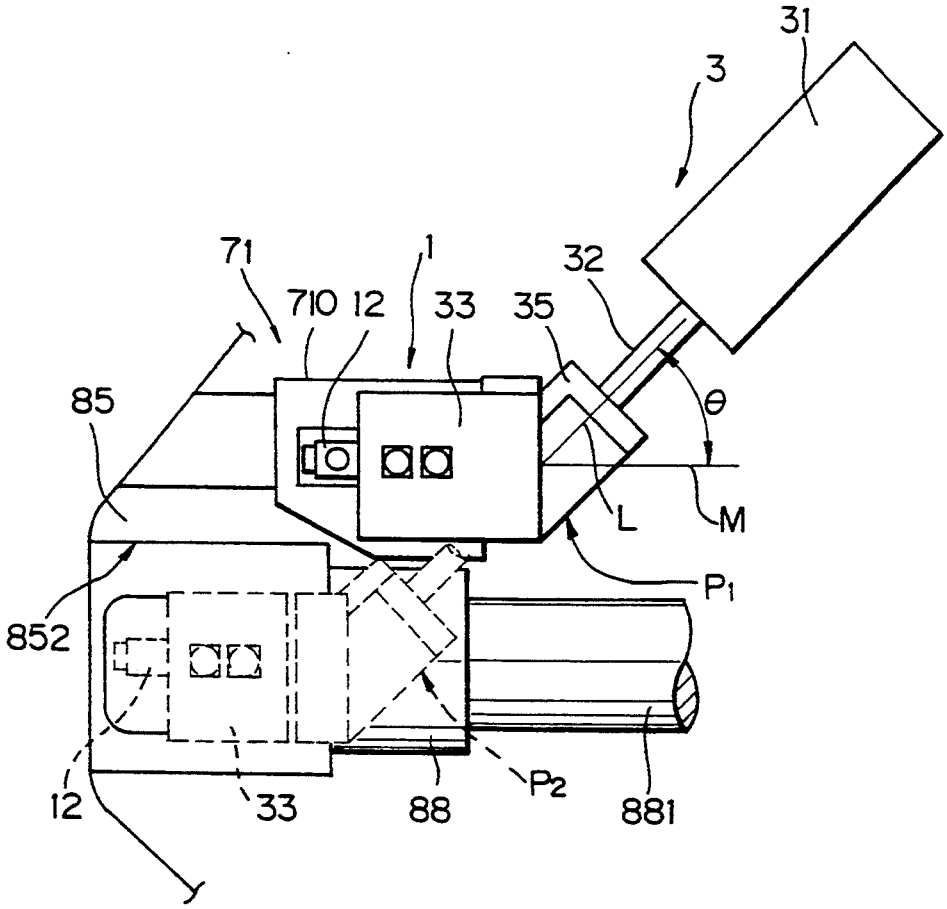
FIG. 3 is an enlarged plan view of a moving device in FIG. 1.
Figure 4:
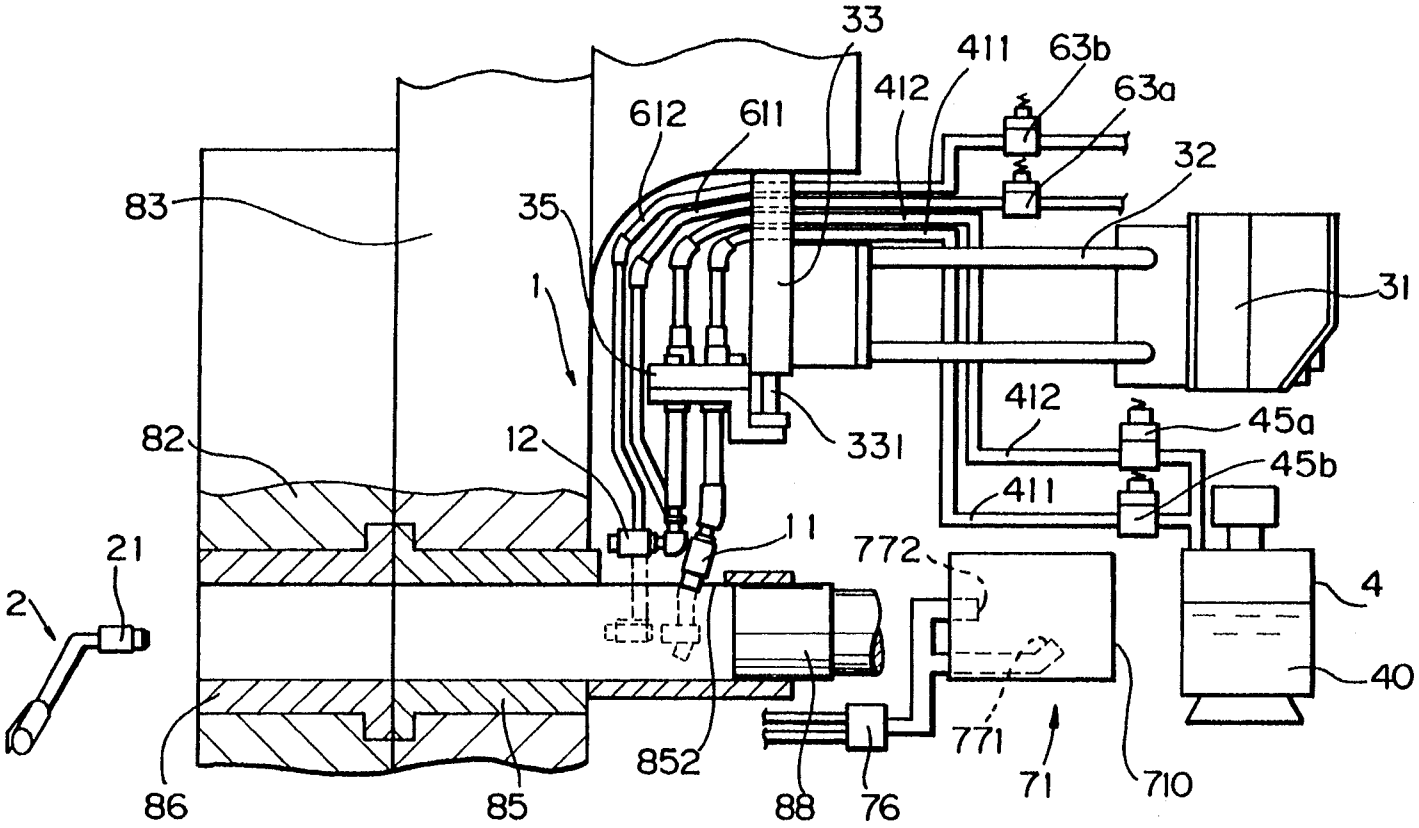
FIG. 4 is an enlarged side view of the first spraying assembly in FIG. 1.

The nozzle moving unit 3 is constructed by a first cylinder unit 31 for obtaining a horizontal movement of the first spray unit 1, and a second cylinder unit 33 for obtaining a vertical movement of the spray unit 1. Namely, the first cylinder unit 31 includes a piston rod 32 moving in a horizontal plate, which is connected to a body of the second cylinder unit 33. The second cylinder unit 33 has a piston rod 331 connected to the stay 35 of the first spray assembly 1. As shown in FIG. 3, the piston rod 32 of the first cylinder unit 31 has an axis L which is inclined with the axis M which is parallel to the axis of the plunger 88 at an angle $\theta$, which is, for example, equal to 45 degree. These cylinders 31 and 33 may be constructed as an oil cylinder, air cylinder or electromagnetic cylinder.

In FIG. 2, the tank 4 is for storing the solid lubricant which is constructed, for example, from boron, graphite, molybdenum disulfide, mica or talc, which is under a condition of fine particles (powder) dispersed in a liquid, such as a water or alcohol for easing the spraying operation of the lubricant to the inner surfaces of the injection sleeve 85 and the spool bushing 86. The lubricant tank 4 is connected to the melt inlet nozzle 11 and the inwardly directed nozzle 12 of the spray assembly 1 via pipes 411 and 412, respectively. Flow meters **44*a* and 44*b* and electromagnetic ON-OFF valves 45*a* and 45*b* are arranged on the pipes 411 and 412, respectively. Connected also to the nozzles 11 and 12 are air pipes 611 and 612, respectively, which are connected to a compressed air source (not shown), so that flows of compressed air are obtained, which entrain the powdered lubricant in the nozzles 11 and 12, respectively, so that the lubricant is sprayed from the nozzles 11 and 12 toward the inner surface of the injector sleeve 85. Arranged on the pipes 611 and 612 are electromagnetic ON-OFF valves 63*a* and 63*b* for controlling the flow of the compressed air. Connected to the air pipes 611 and 612 to the nozzles 11 and 12, respectively are pipes 54*a* and 54*b* from the mixing block 53 of the cleaning device 5. As a result, the cleaning liquid can be introduced into the nozzles 11 and 12 when the cleaning operation of the nozzles 11 and 12** is executed.

As shown in FIG. 1, the second spray assembly 2 is constructed by a nozzle 21, and a vertical cylinder unit 23 having a piston rod 23-1 connected to the nozzle 21. Upon the lubricant spraying operation, the piston rod 23-1 is extended as shown by dotted line so that the nozzle 21 faces the spool bushing 86. Upon the completion of the spraying operation, the piston rod 23-1 is contracted, so that the horizontal movement of the movable mold 81 toward the fixed mold 82 is not interfered with by the nozzle. In the same way as the first spray for assembly 1, as shown in FIG. 2, the lubricant tank 4 is connected to the nozzle 21 via a lubricant pipe 42. A flow meter 44 and an electromagnetic ON-OFF valve 46 are arranged on the pipe 42. Also in the same way as the first spray assembly 1, an air pipe 62, connected to a compressed air source (not shown), is connected to the nozzle 21, so that the flow of the compressed air entrains the solid lubricant at the nozzle 21, so that the lubricant is sprayed toward the spool bushing 86. Connected also to the air pipe 62 is a cleaning water pipe 54 from the mixing block 53 of the cleaning unit 50.

Figure 5:
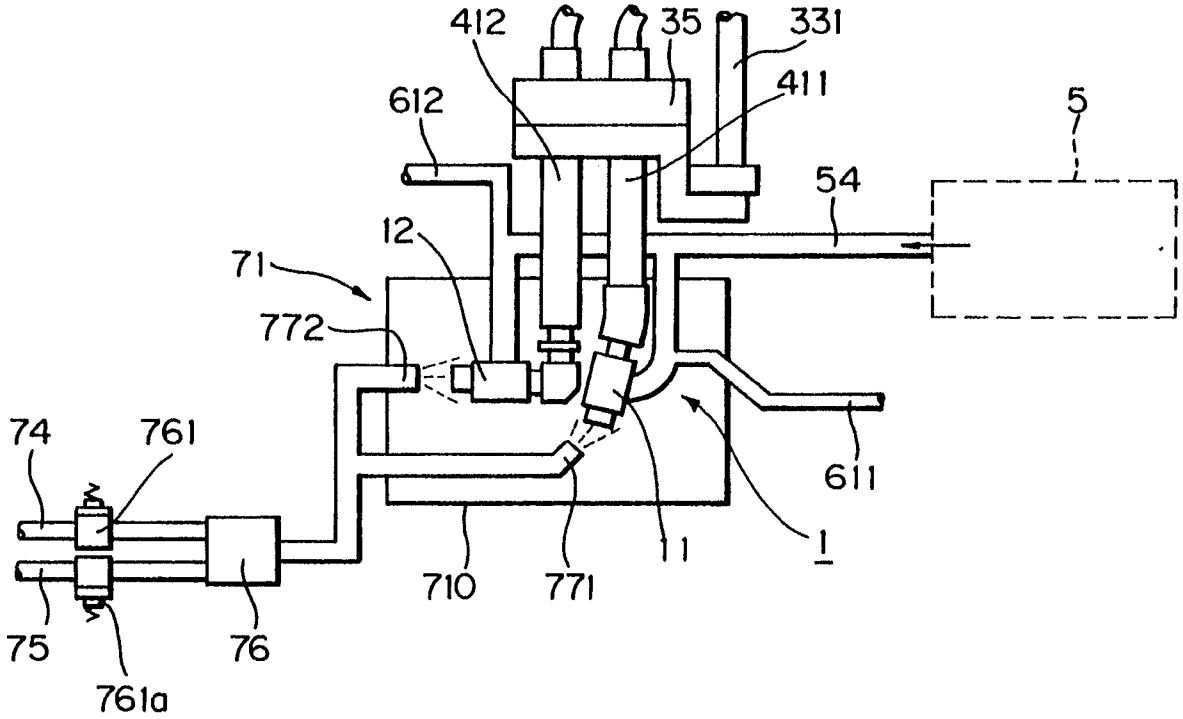
FIG. 5 is an enlarged side view of the first cleaning device in FIG. 1.

The first nozzle cleaning unit 71 is arranged on a location where it can be cooperated with the first spray assembly 1 to clean its nozzles 11 and 12 when the nozzles 11 and 12 are removed from the injection sleeve upon the completion of the spraying operation of the solid lubricant. The nozzle cleaning unit 71 includes a box 710 which is located at a position on one side of the plunger 88 as shown in FIG. 3. A vertical movement of the piston rod 331 (FIG. 5) of the cylinder 35 causes the melt inlet nozzle 11 and the inwardly directed nozzle 12 to be inserted to the box 710 for executing the cleaning operation of the nozzles 11 and 12. Namely, as shown in FIG. 5, cleaning water outlets 771 and 772 are opened to the space inside the box 710 so that the water outlets 771 and 772 face the melt inlet nozzles 11 and the inwardly directed nozzle 11 introduced into the box 710. The water outlets 771 and 772 are connected to a mixing block 76 to which a water introduction pipe 74 and an air introduction pipe 75 are connected. The water introduction pipe 74 is connected to a source of the water (not shown), and an electromagnetic ON-OFF valve 761 is arranged on the water introduction pipe 74 for controlling the introduction of the water into the mixing block 76. The air introduction pipe 75 is connected to a source of a compressed air (not shown), and an electromagnetic ON-OFF valve **761*a* is arranged for controlling the introduction of the air into the mixing block 76. As shown in FIG. 3, the box 710 of the nozzle cleaning unit 71 is located below the vertical cylinder 33 which is under the retracted position of the horizontal cylinder 31, where the piston rod 32 of the cylinder 31 is retracted. The horizontal cylinder 31 is energized so that the piston rod 32 is extended as shown by a dotted line, where the first injection spray assembly 1 is located above the melt inlet 852**.

As for the second spraying assembly 2, a nozzle cleaning device 72 is also provided for cleaning inner and outer sides of its nozzle 21. The second nozzle cleaning device 72 has a construction which is similar to that of the first nozzle cleaning device 71 and therefore its detailed explanation will be omitted to avoid repetition.

Now, an operation of the apparatus according to the present invention will be described. Upon a die-casting operation, the first injector assembly 1 and the second nozzle assembly 1 and 2 are both under retracted positions, respectively. The moving mold 81 is in a position where it contacts with the fixed mold 83 so that a cavity is created by the recess 811 and 821, and the molten metal material is introduced, via the inlet 852, into the cylindrical bores of the injection sleeve 85 and the spool bushing 86. Prior to the introduction of the molten metal material, the solid lubricant is sprayed to the inner surface of the injection sleeve 85 and the spool bushing 86, as will be fully described later. Then, the plunger 88 is moved so that the molten metal material is forced into the cavity for commencing the die-casting operation.

Upon the completion of the die-casting operation, the moving mold 81 is moved so that it is detached from the fixed mold 82, and a product as obtained is taken out from the molds 81 and 82 by means of the ejector pin 812. A releasing agent is applied to the surfaces of the cavity for the subsequent die-casting operation.

Upon the completion of the mold opening process, the cylinder 23 of the second spraying assembly 2 is energized, so that the nozzle 21 is extended to a position where the nozzle 21 is faced with the spool bushing 86. The solid lubricant is sprayed toward the inner cylindrical bore of the spool bushing 86 as shown by the dotted line in FIG. 1. Also upon the completion of the mold opening process, the piston rod 32 of the horizontal cylinder 31 of the first moving device 3 is extended, so that the stay 35 together with the nozzles 11 and 12 and the vertical cylinder 33 is moved from the retracted position as shown by a solid line $P_1$ in FIG. 3 to the extended position $P_2$ as shown by a dotted line, where the nozzles 11 and 12 on the stay 35 are located above the molten metal introduction opening 852. Then, the vertical cylinder 33 is operated, so that the melt inlet nozzle 11 are lowered to a position as shown by a solid line in FIG. 2 in a same level as that of the melt inlet opening 852. The melt inlet nozzle 11 is, then, operated, so that the solid lubricant is sprayed mainly to the inner surface of the injection sleeve adjacent the molten metal introduction opening 852. Then, the vertical cylinder 33 is further operated, so that the second nozzle 12 of the first spray assembly 1 is fully located inside the injection sleeve 85 as shown by a dotted line in FIG. 2. The solid lubricant 40 is then sprayed from the second nozzle 12 in a direction toward the cavity. As a result, a uniform heat insulating coating of the solid lubricant, uniformly formed on the entire inner cylindrical wall of the injection sleeve 85 and the spool bushing 85, is obtained.

During the spraying operation, the electromagnetic valves **45*a* and 45*b* are opened, so that the solid lubricant 40 suspended in the liquid from the tank 4 is, via the pipes 411 and 412, introduced into the nozzles 11 and 12. At the same time, the electromagnetic valves 63*a* and 63*b* are opened, so that the compressed air from the compressor (not shown) is introduced into the pipes 411 and 412. As a result, the flows of the compressed air entrains the lubricant in the nozzles 11 and 12, and is sprayed toward the inner surfaces of the injection sleeve 85 and the spool bushing 86. Same spraying operation is also obtained for the second spray assembly 2. Namely, the solid lubricant suspended in the liquid is supplied from the tank 4 to the pipe 42 connected to the nozzle 21, and the compressed air is introduced into the nozzle 21 via the pipe 62. As a result, the lubricant is sprayed from the nozzle 21 toward the spool bushing 86**.

Upon the completion of the spraying operation of the solid lubricant, the vertical cylinder 33 is first retracted by moving upwardly the first spraying unit 1 to the position $P_2$ in FIG. 3 as shown by the dotted line. The horizontal cylinder 31 is, then, retracted so that the first spraying unit 1 is moved from the position $P_2$ to the fully retracted position $P_1$ as shown by the solid line in FIG. 3. At this position $P_1$, the first spraying unit 1 is located above the nozzle cleaning apparatus 71. The vertical cylinder 33 is, then, operated so that the piston rod 331 is extended, so that the nozzles 11 and 12 of the first spraying unit 1 is moved downwardly so as to be introduced into the cleaning box 710 of the cleaning device 71 as shown in FIG. 5. At the inside cleaning device 5, the valves 511 and 521 are opened, so that the air from the compressor (not shown) and the water from the water source (not shown) are mixed at the block 53 to obtain a cleaning liquid, which is supplied, via the pipes **54*a* and 54*b*, to the pipes 611 and 612 to the nozzles 11 and 12. As a result, the cleaning water is injected into the nozzles 11 and 12 for carrying out the cleaning operation. The nozzles 11 and 12 of the first spraying unit 1 are located so as to face the water outlets 771 and 772, respectively. Then, the compressed air from the air source (not shown) and the water from its source (not shown) are mixed at the block 76 of the outside cleaning device 50 and is discharged from the water outlets 771 and 772 toward the nozzles 11 and 12 for cleaning them at their outer side. As a result, a cleaning operation of the melt inlet nozzle 11 and the inwardly directed nozzle 12 are executed at both of the inner and outer sides thereof, so that the solid lubricant is completely washed away from the surfaces of the nozzles. With regard to the nozzle 21 of the second spraying assembly 2, the cleaning apparatus 50 and the nozzle cleaning device 72 operate similarly as the first cleaning apparatus 5 and the nozzle cleaning device 71 operate. Namely, after completion of the spraying operation of the lubricant, the nozzle 21 of the second spray assembly 2 is introduced into the nozzle cleaning device 72. The water entrained by the flow of the air is then introduced into the nozzle 21 and is injected therefrom so that the nozzle 21 is cleaned at its inner side. At the same time, the cleaning water is injected toward the outer side of the nozzle 21 from an outlet not shown in the drawing but has the similar construction as the water outlet 771 or 772 in FIG. 5. As a result, the cleaning of the nozzle 21 of the second spraying unit 2** is completed.

Figure 6:
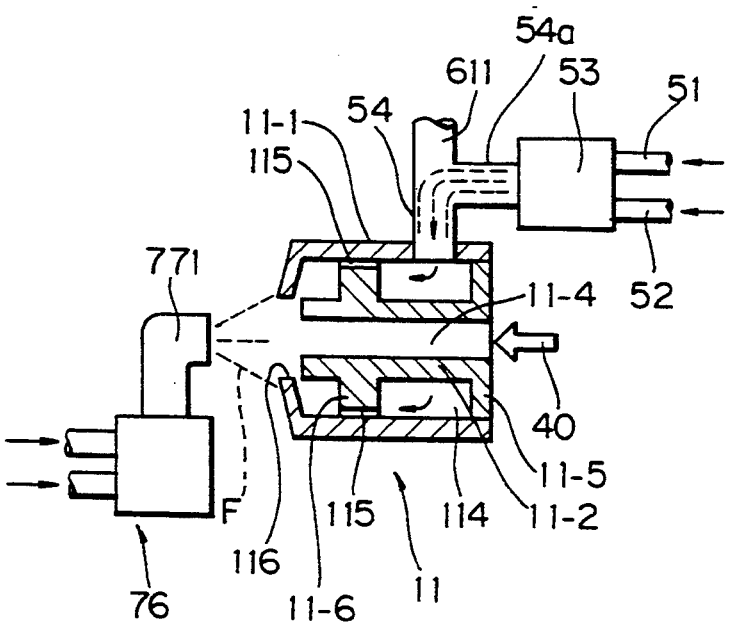
FIG. 6 is an enlarged cross sectional view of a melt inlet nozzle together with the system for cleaning the nozzle.

Now, a detail of the cleaning operation will be explained with reference to the melt inlet nozzle 11 of the first spraying unit 1 together with its construction. With regard to the nozzles 12 and 21, the same operation is obtained. As shown in FIG. 6, the nozzle 11 is formed with an outer tubular housing 11-1 and an inner body 11-2 which is inserted to the outer housing 11-1. The outer housing 11-2 has a nozzle hole 116 for discharging the lubricant. The inner body 11-2 has an axial, central bore 11-4 having a first end connected to the lubricant tank 4 via the pipe 411 in FIG. 2, and a second end opened inwardly of the nozzle hole 116. The inner body 11-2 is provided with axially spaced apart flange portions 11-5 and 11-6. The rear flange 11-5 is fitted to the tubular housing 11-1 in a fluid tight manner. An annular chamber 114 is formed inside the housing 11-1 between the flanges 11-5 and 11-6, and is connected to the air pipe 611 from the compression air source. The inner flange 11-6 is formed with a plurality of circumferentially spaced grooves 115, so that the compressed air from the pipe 611 is, first, introduced into the annular chamber 114 and then discharged from the nozzle hole 116. The flows of the air discharged from the nozzle hole 116 causes the lubricant particles in the central bore 11-4 to be entrained, so that the lubricant is sprayed from the nozzle 11.

When a cleaning operation of the nozzle 11 is done, the melt inlet nozzle 11 together with the second nozzle 12 is located in the box 710 of the cleaning device 71, so that the nozzle 11 is faced with the water outlet 771. The cleaning water as obtained at the mixing block 53 is introduced into the pipe 611 so that the cleaning water is introduced into the nozzle via the chamber 114, so that the cleaning water is injected from the nozzle hole 116. As a result, the inside of nozzle 11 is cleaned. Simultaneously, the cleaning water from the water outlet 771 is directed to the nozzle 11 as shown by dotted arrow F, so that the nozzle is cleaned at its outside. It should be noted that, according to a preferred embodiment of the present invention such a cleaning operation is carried out every time after a die-casting operation.

Figure 7:
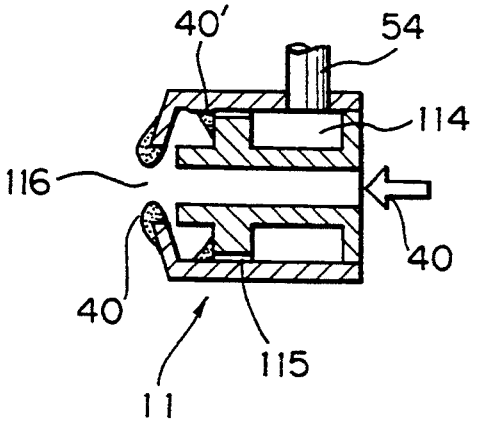
FIG. 7 is similar to FIG. 6, but illustrates when the cleaning of the nozzle is not executed.

No cleaning operations after molding operations would cause solid lubricant to remain in the nozzles. FIG. 7 shows an example of the condition of the nozzle 11 when the cleaning operation is not done for, for example, 400 consecutive molding operations. After the completion of the die-casting operation, a large amount of the lubricant is deposited on the nozzle in particular at a location 40 adjacent the nozzle hole 116 and a location 40' adjacent the grooves 115. Such a deposition 40 and 40' of the lubricant particles causes an effective diameter of the nozzle hole 116 to be reduced, causing the condition and the amount of sprayed lubricant to be changed from the desired values, resulting in the coating of the lubricant on the inner surfaces of the injection sleeve 85 and the spool bushing 86 to be impaired. Contrary to this, according to the present invention, the cleaning operation of the nozzles 11, 12 and 21 is carried out every time after a completion of a molding process, so that the nozzles are always maintained to a clean condition, allowing a constant amount of the lubricant to be supplied thereto, thereby maintaining the desired quality of the die-casting operation.

EXAMPLE 1

Figure 8:
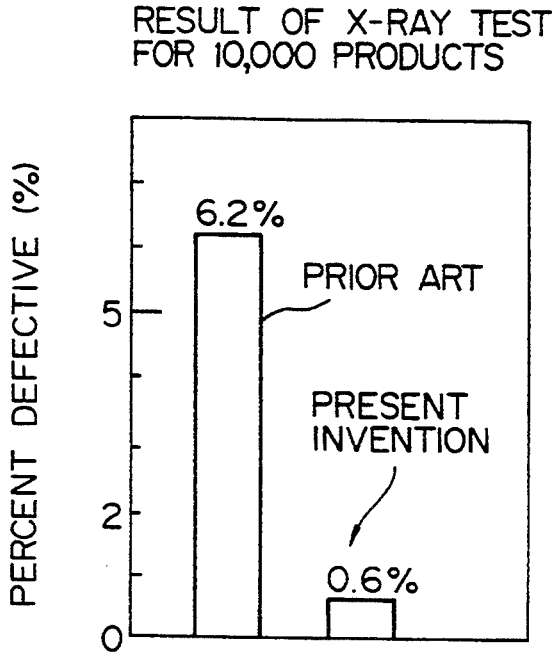
FIG. 8 shows a result of X-ray test of products as obtained according to the present invention in comparison with a prior art.
Figure 9:
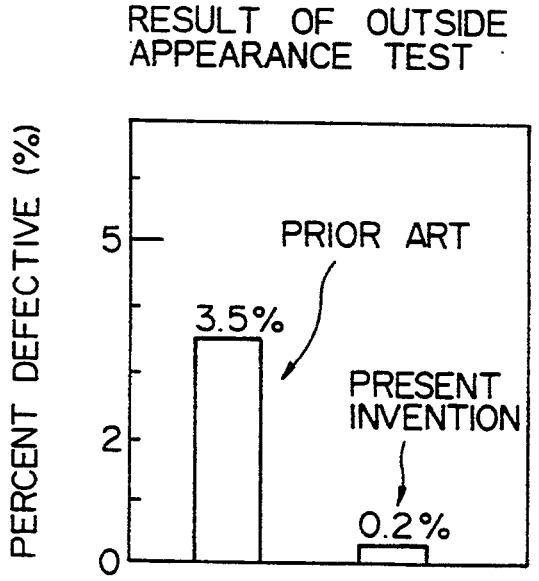
FIG. 9 shows a result of outside appearance test of product as obtained according to the present invention in comparison with a prior art.
Figure 10:
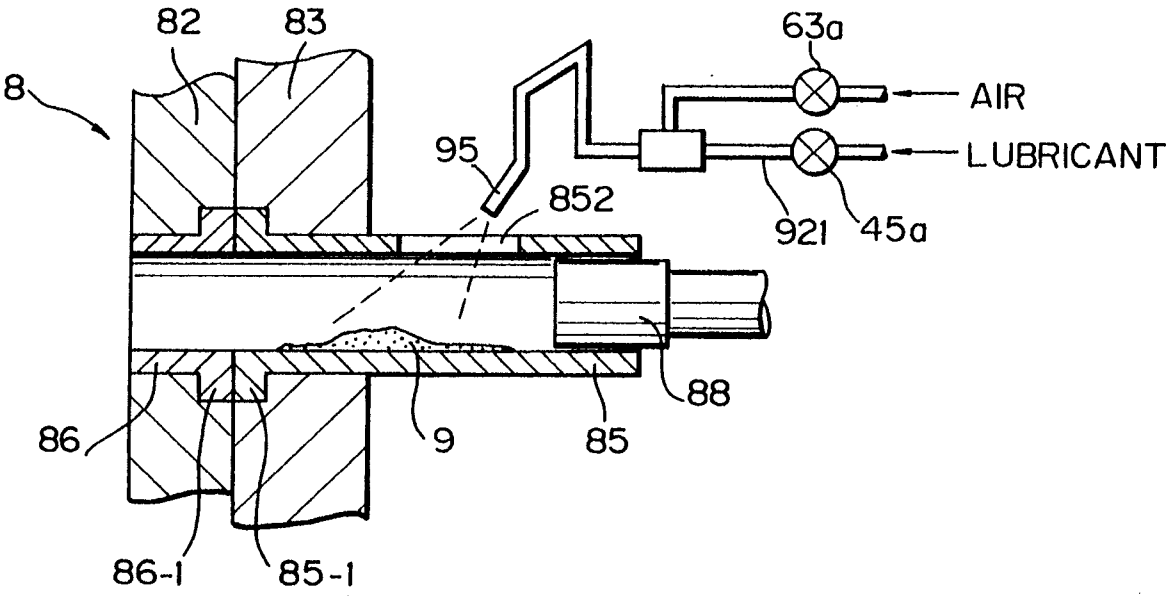
Fig. 10 (PRIOR ART)
FIG. 10 shows a construction of the apparatus for spraying lubricant in the prior art.

Tests were done of casting products using the die-casting apparatus according to the present invention in FIGS. 1 to 6. Checks for voids and for defects in external appearance were carried out on 10,000 finished products. The checking of the voids was done by using a conventional X-ray method. FIG. 8 shows the result and indicates defects for the present invention in comparison with the prior art. FIG. 9 shows the result for the external appearance check, which is done by checking if a product after heat treatment (so-called T6 process) exhibits a swelled portion(s) which is noticeable. The T6 process is an ASTM standard in die-casting operations for aluminum, and consists of a solution treatment of a mold product and an aging treatment after the solution treatment. Existence of a defect (voids) in a prodcut would cause the gas included in the voids to be inflated during the T6 process, causing the product to be partially swelled, resulting in the product to be rejected as being defective. FIG. 10 shows a construction of the prior art apparatus. In the prior art, in order to supply the lubricant with the aid of the air flow, only a single lubricant nozzle 95 opening to the injection sleeve 85 via the molten metal opening 852 is provided. However, as already explained in the introductory part of the specification, the mere provision of the single nozzle 95 is insufficient to obtain a desired coating of the lubricant along the entire inner surfaces of the injection sleeve 85 as well as the spool bushing 86. Namely, as will be clear from FIGS. 8 and 9, the present invention can obtain a drastic reduction in percent defects in die-cast products.

EXAMPLE 2

Figure 11:
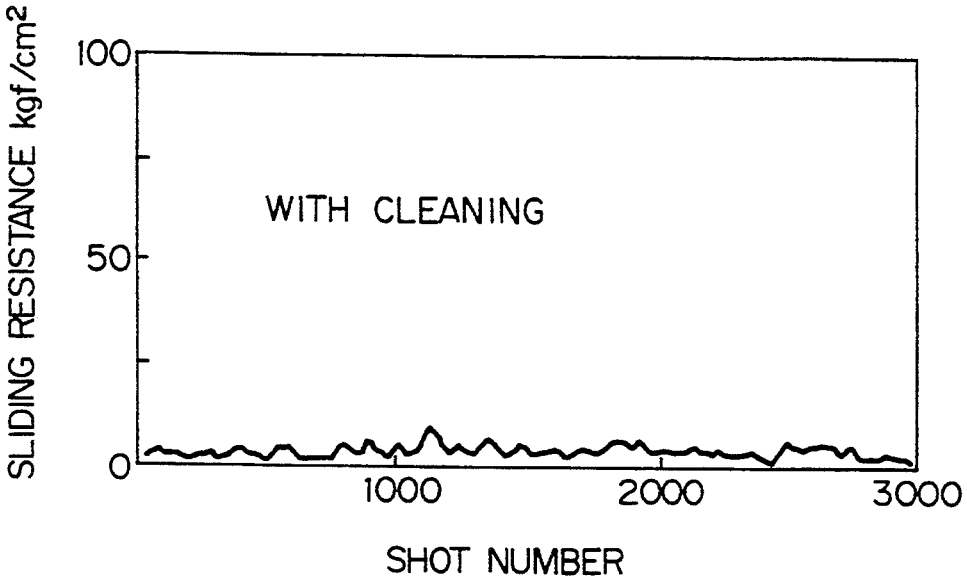
FIG. 11 shows a relationship between a number of shots and a sliding resistance when the cleaning of nozzles is executed in accordance with present invention.
Figure 12:
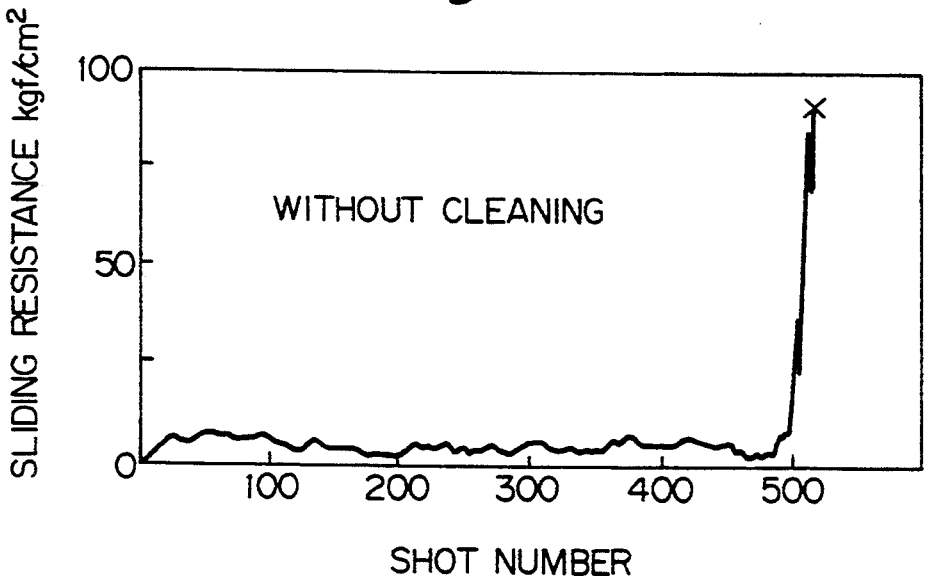
FIG. 12 shows a relationship between a number of shots and a sliding resistance when the cleaning of nozzles is not executed.

Next, tests were done on producing products by the apparatus according to the present invention in FIGS. 1 to 6 under a condition with the nozzle cleaning operation according to the present invention and a condition without such a nozzle cleaning operation. FIG. 11 shows a relationship between shot number and the sliding (injection) resistance between the plunger 88 and the injection sleeve 85 upon the molding process when the cleaning operation according to the present invention is executed. As easily seen, the cleaning operation according to the present invention makes it possible to maintain a substantially constant value of the sliding resistance of about 10 kgf/cm$^2$, even after 3,000 shots. Contrary to this, as shown in FIG. 12, without the cleaning operation according to the present invention, an increase in the sliding friction was occurred only after 500 shots. The die-casting operation became impossible after about 520 shots, as shown by a point marked x in FIG. 12.

EXAMPLE 3

Figure 13:
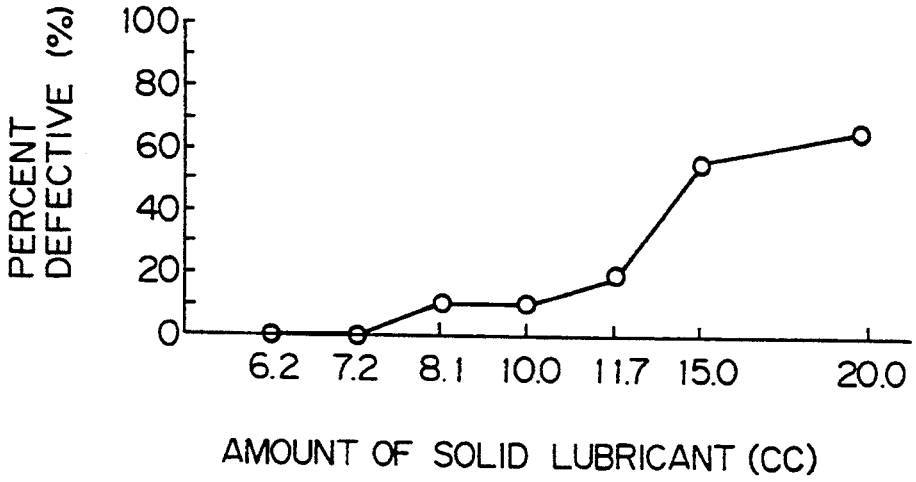
FIG. 13 shows a relationship between the amount of solid lubricant and percent defective of products.
Figure 14:
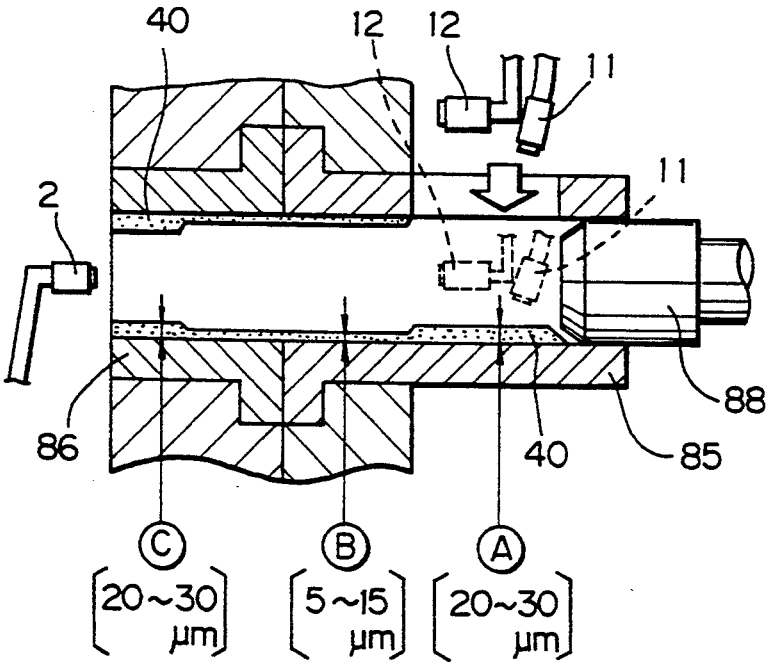
FIG. 14 shows illustrate a coatings having portions of different thickness.

The apparatus as shown in FIGS. 1 to 6 was also used to obtain die-casting products. In this case, the amount of the sprayed lubricant was varied to obtain a value(s) of the thickness of the coating of the lubricant, which can obtain a desired insulating effect. The percent defective was determined by using X-ray checking device. FIG. 13 shows a relationship between the amount of the solid lubricant and the percent defective of products as obtain. It will be understood from FIG. 12 that an amount of the lubricant larger than 8.1 cc causes the inner percent defective to be increased as detected by the above mentioned X-ray test, while an amount of lubricant larger than 8.2 cc is necessary to obtain a desired heat insulating operation for obtaining a continuous die-casting operation. Thus, it was proposed that the thickness of the lubricant is varied between portions in the mold, so that the coating is thickened at a location near the melt inlet 852 and at a location near the outlet of the melt to the cavity to obtain a sufficient thickness of the heat insulating purpose, and is thinned at other locations so long as the die-casting operation is possible. Namely, as shown in FIG. 14, the values of thickness of the lubricant coating are, respectively, values in a range 20 to 30 μm at a region A adjacent the melt inlet port 852 and a region C adjacent the outlet to the cavity, and is a value in a range between 5 to 15 μm at a region B between the regions A and C. A following table shows amount of lubricant as sprayed from the nozzles 11, 12 and 21 respectively, and column (1) is the values of the amount of the sprayed lubricant from the nozzle to obtain a uniform thickness of the lubricant coating, and column (2) is the value of the amount of sprayed lubricant to obtain the varied thickness of the coating as shown illustrated in FIG. 14.

| | Amount of Solid Lubricant (cc) | |
|---|---|---|
| Nozzles | (1) Uniform Thickness | (2) Varied Thickness |
| Melt Inlet Nozzle 11 | 1.6 | 1.6 |
| Inner Nozzle 12 | 3.4 | 1.4 |
| Cavity Nozzle 21 | 3.2 | 3.2 |
| Total Amount | 8.2 | 6.2 |

As will be clear from the column (2), a total amount of the lubricant of 6.2 cc is sufficient to obtain a desired heat insulating performance while maintaining value of percent void detection lower than 0.5%. Furthermore, rapid cooling is not produced. Contrary to this, the uniform thickness of the lubricant coating along the entire surface of the injection sleeve 85 and the spool bushing 86 requires the total amount of lubricant of 8.2 cc to obtain the desired heat insulating performance while keeping the percent defection lower than a desired value.

We claim:

1. A die-casting apparatus comprising:

a fixed mold assembly;

a movable mold assembly movable between an opened position spaced from the fixed mold assembly and a closed position where the movable mold contacts with the fixed mold to form a cavity for casting a product;

a spool bushing opened into the cavity for introduction of a molten metal material into the cavity;

an injection sleeve connected to the spool bushing and having an inlet for the introduction of the molten metal material;

a plunger slidably inserted into the injection sleeve for injecting the molten material from the injection sleeve to the cavity via the spool bushing;

first spraying means for spraying lubricant mainly on an inner surface of the injection sleeve;

second spraying means for spraying lubricant mainly on the inner surface of the spool bushing;

means for moving each spraying means between a first position for spraying the lubricant when the mold is opened and a second position for cleaning each spraying means at an outside of the spool bushing and the injection sleeve, respectively; and means for cleaning the spraying means after the completion of the spraying operation, wherein, during a spraying operation, the first spraying means and the second spraying means are disposed so as to substantially face each other in a spaced relation within the injection sleeve and the spool bushing, respectively.

2. A die-casting apparatus according to claim 1, wherein each of said spraying means comprises a tank of the solid lubricant located on different locations with respect to the spool bushing and the injection sleeve, at least one nozzle for spraying lubricant, and pipe lines for connecting the tank with at least one nozzle.

3. A die-casting apparatus according to claim 2, wherein said solid lubricant is formed as fine particles suspended in liquid.

4. A die-casting apparatus according to claim 2, wherein said first spraying means includes a melt inlet nozzle for obtaining a flow of solid lubricant at a position adjacent to said inlet of the injection sleeve and said second spray means includes an inwardly directed nozzle for obtaining a flow of lubricant towards the spool bushing.

5. A die-casting apparatus according to claim 2, wherein said cleaning means comprise pipe means connected to the nozzles, and means for supplying a forced flow of cleaning fluid to the pipe means so that the flow of the cleaning water is directed to the space inside the nozzles.

6. A die-casting apparatus according to claim 2, wherein said cleaning means comprise cleaning nozzles opened to the outer side of the lubricant spraying nozzles, pipe means connected to the cleaning nozzles, and means for supplying a forced flow of cleaning fluid to the pipe means so that the flow of the cleaning water is directed to the outside of the lubricant spraying nozzles.

7. A die-casting apparatus according to claim 2, wherein said cleaning means comprises first means for introducing the cleaning fluid to the inside of the lubricant spraying nozzles, and a second means for introducing the cleaning water to the outside of the lubricant spraying nozzle.

8. A die-casting apparatus according to claim 5, wherein said cleaning fluid for cleaning the nozzle is formed as a mist state water formed by water to which a compressed air is mixed.

9. A method for preparing a die-casting apparatus for die-casting operation, said die-casting apparatus comprising a fixed mold and a movable mold which is moved between an opened position where the movable mold is spaced from the fixed mold and a closed position where the movable mold contacts with the fixed mold to form a cavity for die-casting a product, a spool bushing having an outlet for introduction a molten metal material to the cavity, an injection sleeve having an inlet for receiving the molten metal material, and a plunger slidable in the injection sleeve for injecting the molten metal material to the cavity via the spool bushing, the method comprising the steps of:

providing spraying assemblies for generating, respectively, flows of solid lubricant;

providing nozzle cleaning devices for cleaning the spray assemblies, respectively;

moving the movable mold to the opened position after completion of a die-casting operation, while locating the spraying nozzles to face the injection sleeve and the spool bushing, respectively so that the spraying nozzle for the injection sleeve and the spraying nozzle for the spool bushing substantially face each other in a spaced relationship within the injection sleeve and the spool bushing;

spraying the lubricant from the spraying assemblies toward the inner spaces of the injection sleeve and the spool bushing, respectively for obtaining heat insulating coatings of lubricant on the inner surfaces of the injection sleeve and spool bushing;

moving the spraying assemblies to cooperate with the respective nozzle cleaning assemblies for cleaning inner and outer sides of the spraying assembly.

10. A method according to claim 9, wherein said spraying step is such that the thickness of the coating of the lubricant at the inlet of the molten metal material and the outlet of the molten metal material is larger than the thickness of the coating at the remaining portion.

11. A method according to claim 10, wherein said cleaning operation of the spraying means is executed every time after a single shot of a molding by the die-casting apparatus.

12. A method for preparing a die-casting apparatus for die-casting operation, said die-casting apparatus comprising a fixed mold and a movable mold which is moved between an opened position where the movable mold is spaced from the fixed mold and a closed position where the movable mold contacts with the fixed mold to form a cavity for die-casting a product, a spool bushing having a passageway having an outlet for introduction a molten material to the cavity, and injection sleeve having an inlet for receiving the molten material and a passageway for the molten material, and a plunger slidable in the injection sleeve for injecting the molten material to the cavity via the spool bushing, the method comprising the steps of:

providing first and second spraying assemblies for generating, respectively, flows of solid lubricant;

providing first and second nozzle cleaning devices for cleaning the spray assemblies, respectively;

moving the movable mold to the opened position after completion of a die-casting operation;

moving the first spray assembly into the passageway of the injection sleeve at its axis via said inlet;

moving the second spray assembly to locate on an end of the passageway of the spool bushing at its axis so that the first spray assembly and the second spray assembly substantially face each other in a spaced relationship within the injection sleeve and the spool bushing;

spraying the solid lubricant from the first and second spraying assemblies toward the injection sleeve and the spool bushing, respectively for creating coatings of the lubricant on their inner surfaces;

moving the first spray assembly to the first cleaning device from the injection sleeve after the completion of the spraying step from the first spray assembly;

moving the second spray assembly to the second cleaning device from the spool bushing after the completion of the spraying step from the second spraying device;

cleaning the first spray assembly by introducing a cleaning water into the first spray assembly while discharging cleaning water to an outer side of the first spray assembly, and;

cleaning the second spray assembly by introducing a cleaning water into the second spray assembly while discharging cleaning water to an outer side of the second spray assembly.

13. A method according to claim 12, wherein said spraying step for creating the coatings on the inner surfaces of the injection sleeve and the spool bushing is such that the thickness of the coating at a portion adjacent the melt inlet opening of the injection sleeve and a portions adjacent the cavity is larger than the thickness of the coating at the remaining portion.

* * * * *